US006432875B1

(12) United States Patent
Akutsu et al.

(10) Patent No.: US 6,432,875 B1
(45) Date of Patent: Aug. 13, 2002

(54) THERMAL RECORDING MATERIAL

(75) Inventors: Mitsuo Akutsu; Nobuhide Tominaga; Keiji Ohya; Koichi Shigeno; Takahiro Mori, all of Urawa (JP)

(73) Assignee: Asahi Denka Kogyo K.K. (JP)

( * ) Notice: Subject to any disclaimer, the term of this patent is extended or adjusted under 35 U.S.C. 154(b) by 0 days.

(21) Appl. No.: 09/451,845

(22) Filed: Dec. 1, 1999

Related U.S. Application Data

(63) Continuation of application No. PCT/JP99/01727, filed on Apr. 1, 1999.

(30) Foreign Application Priority Data

| | | |
|---|---|---|
| Apr. 2, 1998 | (JP) | 10-107082 |
| Sep. 18, 1998 | (JP) | 10-264219 |
| Jan. 13, 1999 | (JP) | 11-7084 |
| Jan. 22, 1999 | (JP) | 11-14732 |

(51) Int. Cl.[7] ..... B41M 5/30
(52) U.S. Cl. ..... 503/209; 503/208
(58) Field of Search ..... 503/208, 209

(56) References Cited

FOREIGN PATENT DOCUMENTS

| | | | |
|---|---|---|---|
| JP | 56144193 | A | 11/1981 |
| JP | 58188842 | A | 11/1983 |
| JP | 60064890 | A | 4/1985 |
| JP | 61160288 | A | 7/1986 |
| JP | 63252782 | A | 10/1988 |
| JP | 02122978 | A | 5/1990 |
| JP | 02172789 | | 7/1990 |
| JP | 02297484 | A | 12/1990 |
| WO | PCT/JP99/01727 | | 4/1998 |
| WO | WO99/51444 | | 10/1999 |

*Primary Examiner*—Bruce H. Hess
(74) *Attorney, Agent, or Firm*—Nixon & Vanderhye P.C.

(57) ABSTRACT

A thermal recording material includes a condensation reaction product of a carboxylic acid component (A) with a polyhydric alcohol component (B) in a thermal recording layer as an essential component, wherein the carboxylic acid component (A) includes (poly) 4-hydroxybenzoic acid represented by the following general formula (I) as an essential component and another monocarboxylic acid and/or dicarboxylic acid as an arbitrary component, and wherein the polyhydric alcohol component (B) includes a polyhydric alcohol which is a trihydric or more alcohol as an essential component and a dihydric low molecular-weight alcohol as an arbitrary component.

(II)

wherein in the general formula(I), a letter p denotes an integer ranging from 0 to 2.

4 Claims, No Drawings

THERMAL RECORDING MATERIAL

This application is a continuation of PCT/JP98/01727 filed Apr. 1, 1999.

BACKGROUND OF THE INVENTION

1. Field of the Invention

The present invention relates to a thermal recording material with improved preservative stability after color development and recording. Particularly, the present invention relates to a thermal recording material in which chromogenic sensitivity is superior because a (poly) 4-hydroxybenzoic acid ester derivative, a particular condensation reaction product, is contained in a thermal recording layer and also in which the preservative stability such as heat resistance, light resistance, and oil resistance of the thermal recording material recorded by color developing (hereinafter, referred to as "a recording material body") is improved.

2. Description of the Related Art

A thermal recording material is manufactured by applying a chromogenic substance which is usually colorless or hypochromic and a developer which develops chromogenic substance with heat to a surface of a supporting member such as paper, synthetic paper, a plastic film, or a sheet along with a sensitizer, a binder and other additives. When an exothermic device such as a thermal head and a thermal pen comes into contact with a recording apparatus, the chromogenic substance reacts with the developer to turn to be black and the like so as to obtain a thermal recording body. Since this thermal recording body is superior due to no necessity of a complex treatment such as development or fixation compared with another recording body using other means, obtainability of record by a relatively simple apparatus and in a sort time, a small noise during recording, low-level environmental pollution, and low cost, this recording body is not only utilized for copying books, documents, and the like but also is widely utilized as a recording material for a various recording papers for measurement, a computer, a facsimile, a telex, an automat for a ticket and the like, a prepaidcard, a label and the like.

From the viewpoint of initial color development sensitivity of the thermal recording body and dirt of a ground portion (ground portion fog), conventional thermal recording materials have actually satisfactory quality, when a chromogenic substance (a leuco dye), the developer which develops color with heat, and the sensitizer which is utilized as needed are used in a proper combination.

However, the thermal recording body using these conventional thermal recording materials has defects such as fading or disappearance of a printing portion when the thermal recording body is exposed to sunlight or lighting for a long time, and yellowing the ground portion. Therefore, when the recording bodies which are printed out by a facsimile, a word processor or a computer are allowed to stand on a desk, recorded images become smudgy to cause a problem in storage documents for a long time.

Moreover, as described above, the thermal recording body using the conventional thermal recording material is inferior in light resistance, and also when the thermal recording body is stored under high temperature and/or high humidity, there are defects such as disappearance of the printing portion or the generation of ground portion fog. Thus, there has been a long felt need for improvement in the preservative stability of a thermal recording body.

As disclosed in Japanese Unexamined Patent Publication Nos. Showa 56-144193, 58-188842, 60-64890, 63-252782 and the like, 4-hydroxybenzoic acid ester derivatives have been proposed to use as developers, and they are sill utilized now. However, although these compounds have satisfactory chromogenic sensitivity, preservative stability of the thermal recording body is not satisfactory, so that a further improvement has been desired.

In addition, as disclosed in Japanese Unexamined Patent Publication No. Heisei 2-122978 and the like, a thermal recording material using an aromatic carboxylic acid ester derivative of pentaerythritol is proposed, and as disclosed in Japanese Unexamined Patent Publication No. Heisei 2-172789 and the like, another thermal recording material using an aromatic carboxylic acid ester derivative of trimethylol alkane is proposed. However, although these compounds are superior in compatibility with various additives to be used for the thermal recording material, they only function as a snsitizer and do not have developing ability, so that they do seldom contribute to the above described improvement of the preservative stability.

SUMMARY OF THE INVENTION

It is an object of the present invention is to provide a thermal recording material having superior initial color development sensitivity as conventional materials and also having a superior preservative stability as a thermal recording body.

After conducting an intensive research and investigation to solve the above described disadvantage, the inventors have discovered that a thermal recording material having superior initial color development sensitivity and also having a superior preservative stability can be obtained by adding a (poly) 4-hydroxybenzoic acid ester derivative which is a certain condensation reaction product having a particular molecular structure into a thermal recording layer, and have attained this invention.

A summary of the present invention will be described below.

In a first aspect, the present invention provides a thermal recording material including a condensation reaction product (hereinafter, the condensation reaction product will be simply referred to as a (poly) 4-hydroxybenzoic acid ester derivative) of a carboxylic acid component (A) with a polyhydric alcohol component (B) in a thermal recording layer as an essential component, wherein the carboxylic acid component (A) includes a (poly) 4-hydroxybenzoic acid represented by the following general formula (I) as an essential component and another monocarboxylic acid and/or dicarboxylic acid as an arbitrary component, and wherein the polyhydric alcohol component (B) includes a polyhydric alcohol which is a trihydric or more alcohol as an essential component and a dihydric low molecular-weight alcohol as an arbitrary component:

(I)

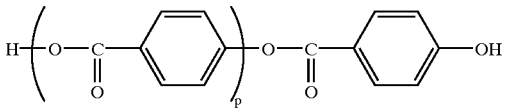

wherein in the general formula(I), a letter p denotes an integer ranging from 0 to 2.

In a second aspect, the present invention provides a thermal recording material in accordance with the first aspect of the invention, wherein the polyhydric alcohol which is the trihydric or more alcohol as the essential component is represented by a following general formula (II):

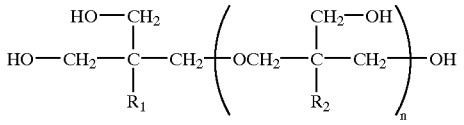

(II)

wherein in the general formula(II) a letter n denotes an integer ranging from 0 to 9, and $R_1$ and $R_2$ that may be present in n types are, independently of one another, a hydroxymethyl or an alkyl group having from 1 to 8 carbon atoms.

In a third aspect, the present invention provides a thermal recording material in accordance with the first aspect of the invention, wherein the condensation reaction product as the essential component is obtained by using the 4-hydroxybenzoic acid at a mole fraction ranging from 1 to 150, another monocarboxylic acid at a mole fraction ranging from 0 to 50, the dicarboxylic acid at a mole fraction ranging from 0 to 1, the trihydric or more alcohol at a mole fraction ranging from 1 to 50, and the dihydric low molecular-weight alcohol at a mole fraction ranging from 0 to 50.

In a fourth aspect, the present invention provides a thermal recording material in accordance with the second aspect of the invention, wherein a letter n denotes ranging from 1 to 9, and $R_1$ and $R_2$ are hydroxymethyl, in which the trihydric or more alcohol is polypentaerythritol.

In a fifth aspect, the present invention provides a thermal recording material in accordance with the second aspect of the invention, wherein a letter n denotes ranging from 1 to 9, and $R_1$ and $R_2$ are ethyl, in which the trihydric or more alcohol is polytrimethylol propane.

DESCRIPTION OF THE PREFERRED EMBODIMENT

These and other objects and features of a thermal recording material in accordance with the present invention will become more apparent from the following detailed description.

Materials utilized for condensation reaction in accordance with the present invention are basically a carboxylic acid component (A) and a polyhydric alcohol component (B), wherein the carboxylic acid component (A) includes a (poly) 4-hydroxybenzoic acid as an essential component and a monocarboxylic acid and/or a dicarboxylic acid as an arbitrary component, and wherein the polyhydric alcohol component (B) comprises a polyhydric alcohol which includes a trihydric or more alcohol as an essential component and a dihydric low molecular-weight alcohol as an arbitrary component.

A Carboxylic Acid Component (A)

The carboxylic acid component (A) means a (poly) 4-hydroxybenzoic acid alone or a mixture including the (poly) 4-hydroxybenzoic acid and another arbitrary carboxylic acid.

Furthermore, the (poly) 4-hydroxybenzoic acid means 4-hydroxybenzoic acid, a poly 4-hydroxybenzoic acid, or a mixture at an arbitrary rate of these compounds. When 4-hydroxybenzoic acid is used as a raw material, the poly 4-hydroxybenzoic acid is produced during condensation reaction. On the other hand, as described in the following Manufacturing Examples, a poly 4-hydroxybenzoic acid dimer such as 4-hydroxybenzoic acid (4'-carboxy) phenyl may be previously synthesized and may be utilized.

The monocarboxylic acid which is arbitrarily contained as described above is effective for improving dispersibility of the (poly) 4-hydroxybenzoic acid ester derivative in a thermal recording layer and is also effective for preventing ground portion fog. Therefore, the monocarboxylic acid is not particularly limited, so far as the developing effect of the (poly) 4-hydroxybenzoic acid ester derivative, which contributes to an initial concentration of the thermal recording material and to the preservative stability of the thermal recording body in accordance with the present invention, is not inhibited. Thus, the monocarboxylic acid can include other monocarboxylic acids represented by a following general formula (III):

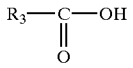

(III)

wherein in the general formula(III), $R_3$ represents an alkyl group or an aryl group.

The alkyl group represented by $R_3$ is, for example, methyl, ethyl, propyl, isopropyl, butyl, secondary butyl, tertiary butyl, isobutyl, amyl, tertiary amyl, hexyl, 1-ethylpentyl, heptyl, isoheptyl, tertiary heptyl, 1-ethylheptyl, but not particularly limited to them. The aryl group represented by $R_3$ is illustrated by the following general formulas (IV) and (V), but not particularly limited to them. Concretely, the aryl group represented by $R_3$ is, for example, phenyl, 2-hydroxyphenyl, 3-chloro-4-hydroxyphenyl, 3,5-ditertiary butyl-4-hydroxyphenyl, 2,4-dihydroxyphenyl, 2,4,6-trihydroxyphenyl, 1-naphtyl, 2-hydroxynaphtyl and the like.

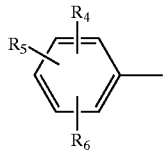

(IV)

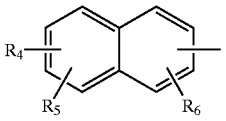

(V)

wherein in the general formula $R_4$, $R_5$, and $R_6$ are, independently of one another, a hydrogen atom, a halogen atom, a hydroxy group, an alkyl group having from 1 to 8 carbon atoms, or an alkoxy group having from 1 to 8 carbon atoms.

The alkyl group having from 1 to 8 carbon atoms represented by $R_4$, $R_5$, or $R_6$ is, for example, methyl, ethyl, propyl, isopropyl, butyl, secondary butyl, tertiary butyl, isobutyl, amyl, tertiary amyl, hexyl, heptyl, octyl, isooctyl, tertiary octyl, 2-ethylhexyl and the like. The alkoxy group is illustrated by those derived from the above mentioned alkyl group, and the halogen atom is illustrated by chlorine, bromine, and fluorine.

In addition, the arbitrarily included dicarboxylic acid (including its ester) can increase a molecular weight of the poly 4-hydroxybenzoic acid ester derivative, and also it is effective for improving the preservative stability of the thermal recording body. Thus, the dicarboxylic acid can be used without a limitation, so far as the developing effect of the (poly) 4-hydroxybenzoic acid ester derivative in the thermal recording material in accordance with the present invention is not inhibited.

There is not a particular limitation with respect to a kind of the arbitrarily used dicarboxylic acid. The usual dicarboxylic acid is, for example, oxalic acid, malonic acid, succinic acid, 1,3-butanedicarboxylic acid, carboxylic acid, adipic acid, azelaic acid, sebacic acid, phthalic acid, isophthalic acid, terephthalic acid and the like.

These monocarboxylic acids or dicarboxylic acids are utilized in the form of a free carboxylic acid, and also utilized in the form of an carboxylic acid ester, an acid anhydride, or an acid halide.

Hydric Alcohol Component (B)

The polyhydric alcohol component (B) in accordance with the present invention includes a trihydric or more alcohol as an essential component and a dihydric low molecular-weight alcohol may be included as an arbitrary component as necessary.

Addition of the trihydric or more alcohol is necessary for obtaining a thermal recording material which forms a thermal recording body having superior chromogenic sensitivity and superior preservative stability. Addition of only the dihydric low molecular-weight alcohol does not reveal the above mentioned effect.

The trihydric or more alcohol used in this invention is, for example, hexitols, pentitols, pentaerythritol, trimethylolethane, trimethylolpropane, tetramethylolpropane, glycerin, condensation products of these trihydric or more alcohols, and condensation products of these trihydric or more alcohols and the dihydric low molecular-weight alcohol, but not particularly limited to them. Specifically, the polyhydric alcohols represented by the following general formula (II) are preferabl, because thermal recording materials having superior chromogenic sensitivity and superior preservative stability as a thermal recording bodies are obtained. Furthermore, pentaerythritol, trimethylolpropane, and/or their condensation products are more preferable.

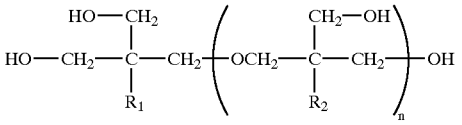

(II)

wherein in the general formula (II) a letter n denotes an integer ranging from 0 to 9, and $R_1$ and $R_2$ that may be present in n types are, independently of one another, a hydroxymethyl group or an alkyl group having from 1 to 8 carbon atoms.

In addition, in order to improve dispersibility of the (poly) 4-hydroxybenzoic acid ester derivative into the thermal recording layer, the dihydric low molecular-weight alcohol, sometimes, may be concomitantly used with the trihydric or more alcohol. So far as there is no problem to decrease the chromogenic sensitivity, the kind of the dihydric low molecular-weight alcohol is not especially limited. Usually used alcohols are glycols such as ethylene glycol, diethylene glycol, propylene glycol, 1,4-butanediol, neopentyl glycol, 3-methyl-1,5-pentanediol, 1,6-hexanediol, and cyclohexanedimethanol.

(Poly) 4-hydroxybenzoic Acid Ester Derivatives

A mole fraction of each raw material to obtain the (poly) 4-hydroxybenzoic acid ester derivative in accordance with the present invention is not particularly limited. However preferably, the (poly) 4-hydroxybenzoic acid (with respect to the poly 4-hydroxybenzoic acid, the mole fraction is calculated after being converted to 4-hydroxybenzoic acid unit mole numbers) is at a mole fraction ranging from 1 to 150; another monocarboxylic acid is at a mole fraction ranging from 0 to 50; the dicarboxylic acid is at a mole fraction ranging from 0 to 1; the trihydric or more alcohol is at a mole fraction ranging from 1 to 50; and the dihydric low molecular-weight alcohol is at a mole fraction ranging from 0 to 50. When a mole fraction of the 4-hydroxybenzoic acid is less than one, the content fraction of the (poly) 4-hydroxybenzoic acid ester group decreases, so that the chromogenic sensitivity tends to be unsatisfactory. In contrast, when a mole fraction of the 4-hydroxybenzoic acid is more than 150, unreacted 4-hydroxybenzoic acid remains, polymerization is insufficient, and it tends to produce ground portion fog. In addition, when a mole fraction of the trihydric or more alcohol is less than one, chromogenic sensitivity tends to be unsatisfactory. In contrast, when a mole fraction of the trihydric or more alcohol is more than 50, it tends to produce ground portion fog.

When mole fractions of the monocarboxylic acid and/or the dicarboxylic acid included arbitrarily, and the dihydric low molecular-weight alcohol included arbitrarily are more than 50, chromogenic sensitivity tends to be unsatisfactory.

As is clear from the description above, the (poly) 4-hydroxybenzoic acid ester derivatives in accordance with the present invention are condensation reaction products obtained by condensation reaction using a particular monocarboxylic acid, a dicarboxylic acid and a particular polyhydric alcohol. Therefore, the products include a single component or a mixture thereof. Although it is difficult to perfectly identify chemical structures of all components, some will be illustrated below. With respect to the "Compound" numbered in each compound means "Condensation reaction product".

For example, the components obtained by a (poly) 4-hydroxybenzoic acid, a monocarboxylic acid, and a relatively low molecular-weight polyhydric alcohol are illustrated by the following compounds Nos. from 1 to 16. In addition, when bonding positions of a plurality of groups including structural units of acid components are not specifically identified as shown Nos.2, 3, 4, 5, 6, 9, 12, 14, 15, and 16, the bonding positions are arbitrary. Compound Nos. 17 and the following the same.

(Compound No.1)

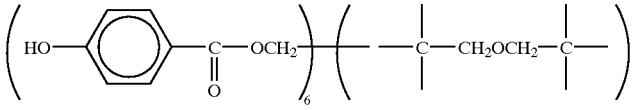

(Compound No.2)

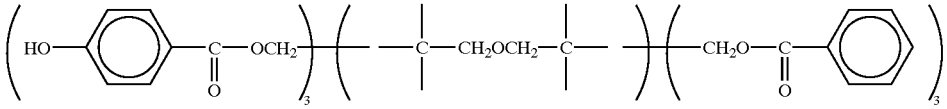

-continued
(Compound No.3)
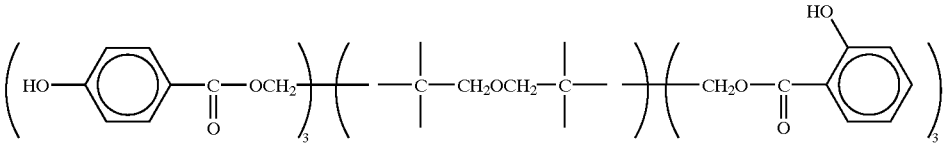
(Compound No.4)
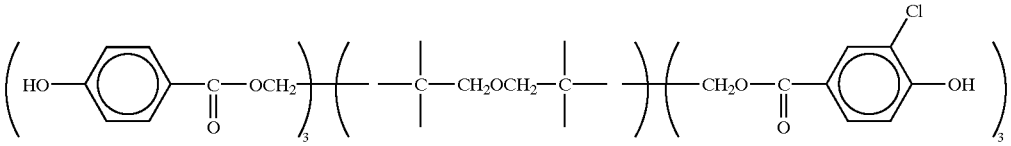
(Compound No.5)
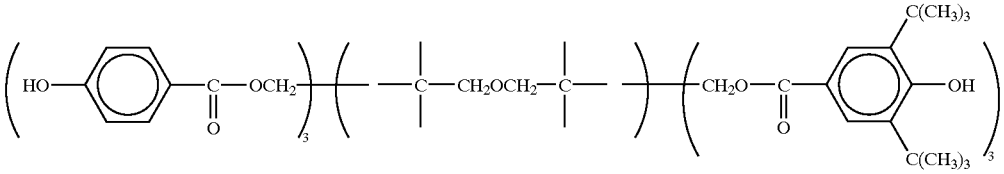
(Compound No.6)
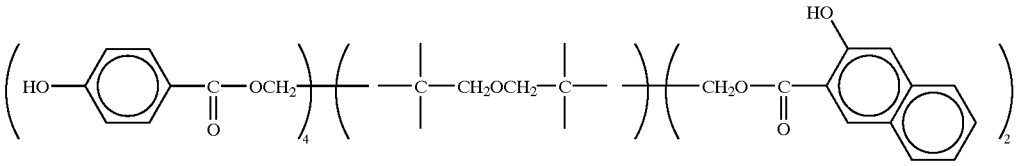
(Compound No.7)
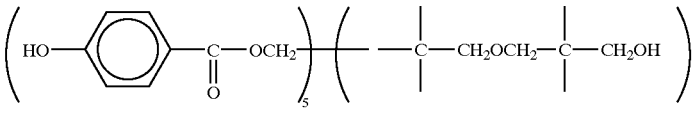
(Compound No.8)
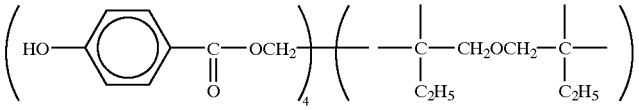
(Compound No.9)
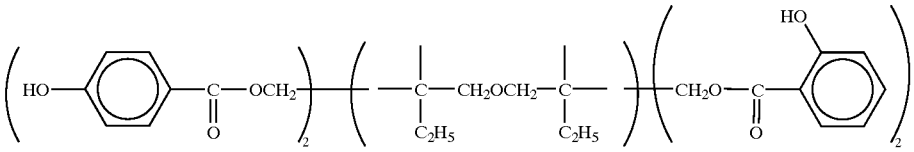
(Compound No.10)
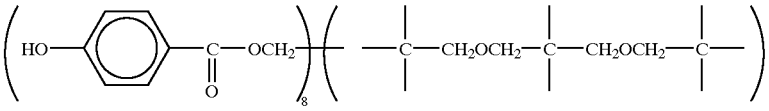
(Compound No.11)
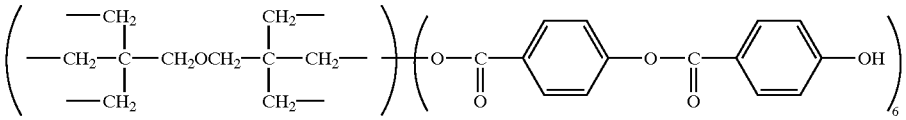
(Compound No.12)
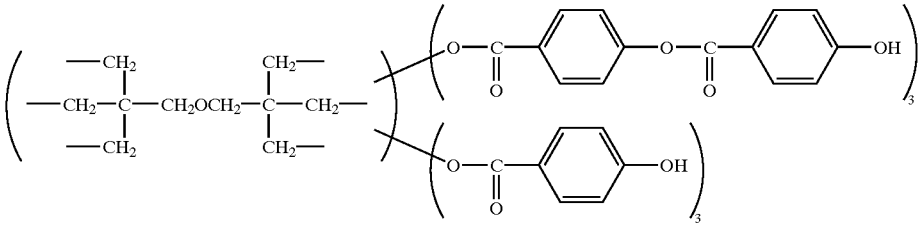

-continued (Compound No.13)

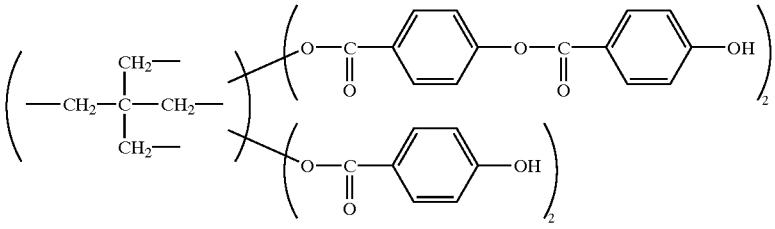

(Compound No.14)

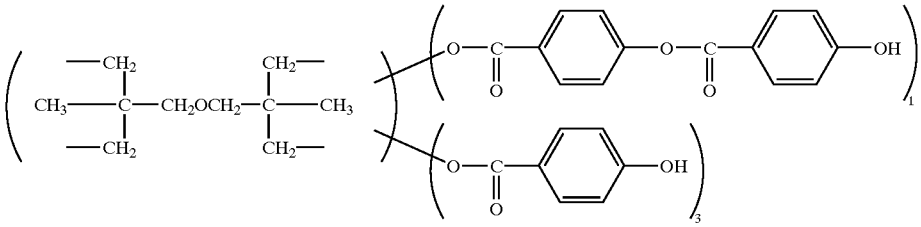

(Compound No.15)

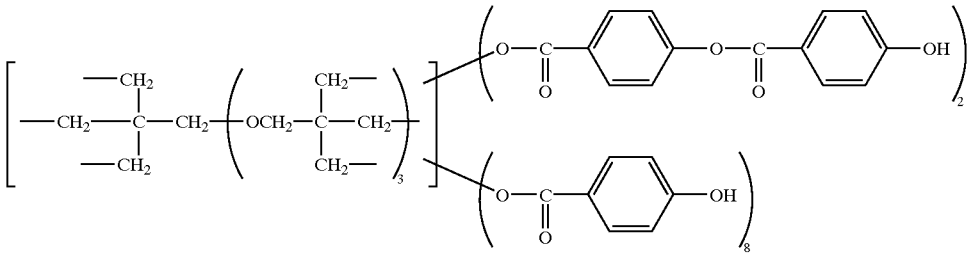

(Compound No.16)

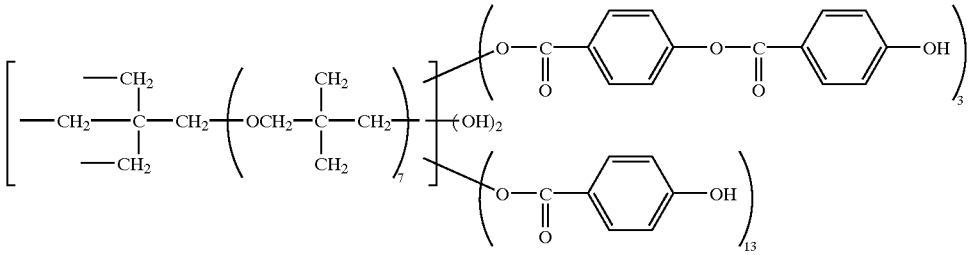

For example, the chemical structures of the condensation reaction product in accordance with the present invention obtained from a (poly) 4-hydroxybenzoic acid, a monocarboxylic acid, and a relatively high molecular-weight polyhydric alcohol are illustrated by the Compounds Nos. from 17 to 37 in Tables form 1 to 3 which are represented by a following general formula (VI).

(VI)

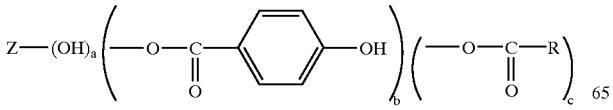

wherein in the general formula (VI), Z represents the following general formula (VII), a denotes from 0 to 2m+3, b denotes from 1 to 2m+4, c denotes from 0 to 2m+3, and a+b+c=2m+4 which are integers, and R is an alkyl group or an aryl group.

(VII)

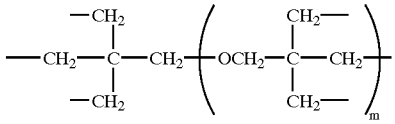

wherein in the general formula (VII), m denotes an integer ranging from 3 to 9.

TABLE 1

| | m = 3 | | | |
|---|---|---|---|---|
| | a | b | c | R |
| Compound No. 17 | 2 | 4 | 4 | methyl |
| Compound No. 18 | 0 | 8 | 2 | 1-ethylpentyl |
| Compound No. 19 | 0 | 7 | 3 | phenyl |
| Compound No. 20 | 3 | 5 | 2 | 2-hydroxyphenyl |
| Compound No. 21 | 1 | 8 | 1 | 3-chloro-4-hydroxyphenyl |
| Compound No. 22 | 2 | 8 | 0 | |
| Compound No. 23 | 0 | 10 | 0 | |

TABLE 2

| | m = 5 | | | |
|---|---|---|---|---|
| | a | b | c | R |
| Compound No. 24 | 0 | 10 | 4 | ethyl |
| Compound No. 25 | 2 | 8 | 4 | n-octyl |
| Compound No. 26 | 4 | 6 | 4 | 4-methoxyphenyl |
| Compound No. 27 | 0 | 7 | 7 | 2-hydroxyphenyl |
| Compound No. 28 | 2 | 6 | 6 | 3-chloro-4-hydroxyphenyl |
| Compound No. 29 | 4 | 10 | 0 | |
| Compound No. 30 | 0 | 14 | 0 | |

TABLE 3

| | m = 9 | | | |
|---|---|---|---|---|
| | a | b | c | R |
| Compound No. 31 | 4 | 10 | 8 | tertiary butyl |
| Compound No. 32 | 0 | 15 | 7 | 1-ethylpentyl |

TABLE 3-continued

| | m = 9 | | | |
|---|---|---|---|---|
| | a | b | c | R |
| Compound No. 33 | 5 | 14 | 3 | phenyl |
| Compound No. 34 | 2 | 18 | 2 | 2-hydroxyphenyl |

TABLE 3-continued

| | m = 9 | | | |
|---|---|---|---|---|
| | a | b | c | R |
| Compound No. 35 | 0 | 12 | 10 | 3-bromo-4-hydroxyphenyl |
| Compound No. 36 | 8 | 14 | 0 | |
| Compound No. 37 | 0 | 22 | 0 | |

The (poly) 4-hydroxybenzoic acid ester derivatives in accordance with the present invention including a dicarboxylic acid as a raw material are mixed esters which is condensation reaction products in which at least one of the remaining hydroxyl group of the condensation product of the polyhydric alcohol and the dicarboxylic acid is esterified with the monocarboxylic acid including the (poly) 4-hydroxybenzoic acid as an essential component (a term "mixed" means that different carboxylic acid esters are included in a molecule). Other components seem to be esters of the polyhydric alcohol and the monocarboxylic acid including the (poly) 4-hydroxybenzoic acid as an essential component (that is, an esterification product of the polyhydric alcohol and the (poly) 4-hydroxybenzoic acid, a mixed esterification product of the polyhydric alcohol, the (poly) 4-hydroxybenzoic acid and the monocarboxylic acid, or mixtures thereof). The mixed esters, main components as mentioned above, which are condensation reaction products in which at least one of the remaining hydroxyl group of the condensation products of the polyhydric alcohol and the dicarboxylic acid are esterified with the monocarboxylic acid including the (poly) 4-hydroxybenzoic acid as an essential component, for example, are represented by the following general formula (VIII). There are given examples such as Compounds from Nos.38 to No.49, which are obtained by condensation reaction using the raw materials described in Table 4 at a mole fraction described in Table 4.

(VIII)

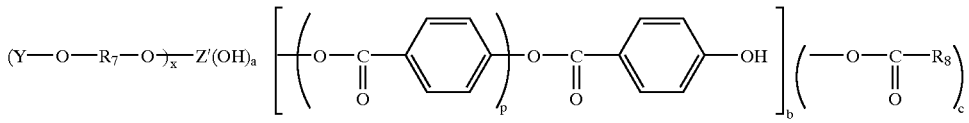

wherein in the general formula (VIII), Y and Z' are, independently of one another, groups in which a hydroxyl group is excluded from the dihydric or more alcohol; letters x, a, b, c, and p denote an integer of 1 or more, an integer of 0 or more, an integer of 1 or more, an integer of 0 or more, and an integer ranging from 0 to 2, respectively; $R_7$ is a diacyl group derived from dicarboxylic acid; and $R_8$ is an alkyl group or an aryl group. When x is not less than 2, Ys are not necessarily the same group.

TABLE 4

| | Dicarboxylic acid | 4-hydroxybenzoic acid | Other monocarboxylic acid | polyhydric alcohol | low molecular weight dihydric alcohol |
|---|---|---|---|---|---|
| Polyhydric alcohol; pentaerythritol | | | | | |
| Compound No. 38 | Terephthalic acid 1 | 18 | — | 4 | Ethylene glycol 2 |
| Compound No. 39 | Isophthalic acid 1 | 6 | — | 2 | — |
| Compound No. 40 | Phthalic acid 1 | 122 | — | 40 | — |
| Compound No. 41 | Terephthalic acid 1 | 16 | acetic acid 6 | 10 | neopentyl glycol 2 |

TABLE 4-continued

| | Dicarboxylic acid | 4-hydroxybenzoic acid | Other monocarboxylic acid | polyhydric alcohol | low molecular weight dihydric alcohol |
|---|---|---|---|---|---|
| 1polyhydric alcohol; trimethylol propane | | | | | |
| Compound No. 42 | Terephthalic acid 1 | 14 | — | 4 | Ethylene glycol 1 |
| Compound No. 43 | Oxalic acid 1 | 62 | 2-hydroxybenzoic acid 30 | 30 | — |
| Compound No. 44 | Malonic acid 1 | 8 | 2-chloro-4-hydroxy benzoic acid 3 | 5 | Diethylene glycol 1 |
| Polyhydric alcohol; dipentaerythritol | | | | | |
| Compound No. 45 | Terephthalic acid 1 | 14 | 2-ethylhexanoic acid 1 | 2 | — |
| Polyhydric alcohol; hexapentaerythritol | | | | | |
| Compound No. 46 | Terephthalic acid 1 | 52 | — | 2 | — |
| Compound No. 47 | Succinic acid 1 | 70 | 1-naphthoic acid 6 | 4 | 1,3-hexanediol 4 |
| Compound No. 48 | Adipic acid 1 | 40 | — | 1 | — |
| Polyhydric alcohol; decapentaerythritol | | | | | |
| Compound No. 49 | Terephthalic acid 1 | 66 | Isobutyric acid 8 | 2 | — |

*in the table, a number denotes mole fractions.

An amount of a (poly) 4-hydroxybenzoic acid ester derivative added in the thermal recording layer in accordance with the present invention changes depending on required performance, recording aptitude, and a kind and an amount of a chromogenic substance (a dye) or other concomitant additives, so that its amount is not particularly limited. Usually, the amount of the (poly) 4-hydroxybenzoic acid ester derivative is preferably used ranging from 0.01 to 10 parts by weight per 1 part by weight of the chromogenic substance (the dye). More preferably, it is used ranging from 0.1 to 5 parts by weight. When the amount of the above described (poly) 4-hydroxybenzoic acid ester derivative is used at a part by weight of less than 0.01, the chromogenic sensitivity may not be sufficient. In addition, when it is used at a part by weight of more than 10, its effect may not increase and uneconomic.

A Chromogenic Substance

With respect to a usually colorless or hypochromic chromogenic substance added to a thermal recording layer in accordance with the present invention, various dyes are well known. Therefore, as long as it is usually used for a thermal recording paper and the like, it is not particularly limited.

Concrete examples of these chromogenic substances (dyes) will be described bellow.

(i) Triarylmethane compounds such as 3,3-bis(p-dimethyl aminophenyl)-6-dimethyl aminophthalimide, 3-(p-dimethyl aminophenyl)-3-(2-phenyl-3-indolyl phthalimide, 3-(p-dimethyl aminophenyl)-3-(1,2,-dimethyl-3-phenyl-3-indolyl)phthalimide, 3,3-bis(9-ethyl-3-carbazoryl)-5-dimethyl aminophthalimide, 3,3-bis(2-phenyl-3-indolyl-5-dimethyl aminophthalimide, 3-(4-diethyl aminophenyl)-3-(1-ethyl-2-methylindole-3-yl)phthalimide, and 3,3-bis[2-(4-dimethyl aminophenyl)-2-(4-methoxyphenyl)vinyl]-4,5,6,7-tetrachlorophthalide;

(ii) Diphenylmethane compounds such as 4,4-bis (dimethyl amino)benzhydrinbenzyl ether, and N-2,4,5-trichlorophenyl leuco auramine;

(iii) Xanthene compounds such as rhodamine-β-anilinolactam, 3-(N-methyl-N-cyclohexylamino)-6-methyl-7-anilino fluoran, 3-diethylamino-7-octylamino fluoran, 3-diethylamino-7-(2-chloroanilino)fluoran, 3-diethylamino-7-(2-fluoroanilino)fluoran, 3-diethylamino-6-methyl-7-anilino fluoran, 3-diethylamino-6-methyl-7-(2,4-dimethylanilino) fluoran, 3-diethylamino-7-dibenzylamino fluoran, 3-diethylamino-6-chloro-7-(β-ethoxyethylamino) fluoran, 3-diethylamino-6-chloro-7-(γ-chloropropylamino)fluoran, 3-(N-ethyl-N-isoamylamino)-6-methyl-7-anilino fluoran, 3-(N-ethyl-N-ethoxyethylamino)-6-methyl-7-anilino fluoran, 3-(N-ethyl-N-tetrahydrofurfurylamino)-6-methyl-7-anilino fluoran, 3-dibutylamino-7-(2-chloroanilino) fluoran, 3-(N-ethyl-N-tolylamino)-6-methyl-7-anilino fluoran, 3-(N,N-dibutylamino)-6-methyl-7-anilino fluoran, 3-dipentylamino-6-methyl-7-anilino fluoran, 3-piperidino-6-methyl-7-anilino fluoran, and 3-(4-anilino)anilino-6-methyl-7-chloro fluoran;

(iv) Thiazin compounds such as benzoyl leuco methylene blue, and p-nitro benzoyl leuco methylene blue;

(v) Spiro compounds such as 3-methylspirodinaphtho pyran, 3-ethylspirodinaphtho pyran, 3-benzylspirodinaphtho pyran and 3-methylnaphtho-(3-methoxybenzo)spiropyran;

(vi) Others such as 3,5',6-tris(dimethylamino)spiro[9H-fluorene-9,1'-(3'H)-isobenzofuran]-3'-one, 1,1,-bis[2-(4-dimethylaminophenyl)-2-(4-methoxyphenyl) ethenyl]-4,5,6,7-tetrachloro(3H)isobenzofuran-3-one, 3-(4-diethylamino-2-ethoxyphenyl)-3-(1-ethyl-2-methylindole-3-yl)-4-azaphthalide, and 3-(4-diethylamino-2-methylphenyl)-3-(1-ethyl-2-methylindole-3-yl)-4-azaphthalide. Moreover, several kinds of these dyes can be used in a mixed substance.

Among them, 3-(N,N,dibutylamino)-6-methyl-7-anilino fluoran, and 3-(N-ethyl-N-isoamylamino)-6-methyl-7-anilino fluoran, and the like are preferable.

A Developer

As described above, since a poly 4-hydroxybenzoic acid ester derivative used in the present invention has a developing ability, other developers are not necessary. However, when it is required to increase the chromogenic sensitivity, known developers such as phenols, carboxylic acids, and metals can be concomitantly used. In addition, an amount of the poly 4-hydroxybenzoic acid ester derivative in accordance with the present invention can be reduced due to concomitant usage of these other developers.

With respect to the above described developers, there are, for example, phenols such as p-octyl phenol, p-tertiary butyl phenol, p-phenyl phenol, p-hydroxyacetophenone, α-naphthol, β-naphthol, p-tertiary octyl catechol, 2,2'-dihydroxy biphenyl, bisphenol A, 1,1,-bis(p-hydroxy phenyl)butane, 2,2-bis(4-hydroxy phenyl)heptane, 2,2-bis-(3-methyl-4-hydroxy phenyl)propane, 2,2-bis-(3,5-dimethyl-4-hydroxy phenyl)propane, 2,2-bis-(3,5-dichloro-4-hydroxy phenyl)propane, bis(4-hydroxy phenyl)sulphone, bis(3-allyl-4-hydroxy phenyl)sulphone, bis(3,4-dihydroxy phenyl)sulphone, 2,4'-dihydroxy diphenyl sulphone, 1,1-bis (4-hydroxy phenyl)cyclohexane, bis(4-hydroxy phenyl) ether, bis[2-(4-hydroxyphenylthio)ethoxy]methane, 4-(4-isopropoxybenzenesulfonyl)phenol, 4-dimethyl hydroxyphthalate, bis(4-hydroxy phenyl)butyl acetate, p-benzyl hydroxybenzoate, 3,5-ditertiary butyl salicylic acid, 2,4-dihydroxybenzanilide, 2,4-dihydroxy-2'-methoxybenzanilide, 2,4-dihydroxy-2',4'-dimethylbenzanilide, 2,4-dihydroxy-2'-methoxy-5'-methylbenzanilide, bis(4-(2,4-dihydroxyphenylcarbonylamino)-3-methoxyphenylmethane, and 4-methylbenzenesulfonic acid-2-hydroxyanilide; resorcinols; organic carboxylic acids such as benzoic acid; and metal salts such as zinc salicylate. Above all, phenols are preferable.

Other Additives

In order to improve chromogenic sensitivity of a thermal recording material in accordance with the present invention, a sensitizer can be used as another additive. The additives are, for example, a metal salt of an organic acid such as zinc acetate, zinc octylate, zinc laurate, zinc stearate, zinc oleate, zinc behenate, zinc benzoate, dodecyl salicylate ester zinc salt, calcium stearate, magnecium stearate, and aliminium stearate; amides such as octadecanamide, behenic acid amide, stearic acid methylol amide, stearoyl urea, acetanilid, acetotoluidide, acetoacetanilide, acetoacetic-o-chloroanilide, benzoylacetanilide, benzoic acid stearyl amide, ethylenebisoctadecanamide, and hexamethylenebis octilamide; 1,2-bis(3,4-dimethyl phenyl)ethane, m-terphenyl, 1,2-diphenoxy ethane, 1,2-bis(3-methylphenoxy)ethane, p-benzyl biphenyl, p-benzyloxybiphenyl, diphenyl carbonate, bis(4-methyl phenyl)carbonate, dibenzyl oxalate, bis(4-methylbenzyl) oxalate, bis(4-chlorobenzyl) oxalate, 1-hydroxy-2-naphthalene carboxylic acid phenyl, 1-hydroxy-2-naphthalene carboxylic acid benzyl, 3-hydroxy-2-naphthalene carboxylic acid phenyl, methylene benzoate, 1,4,bis(2-vinyloxy ethoxy)benzene, 2-benzyloxynaphthalene, 4-benzyloxy benzyl benzoate, dimethyl phthalate, terephthalic acid dibenzyl, dibenzoyl methane, diphenylsulphone, p-toluene sulfonate anilide, 4-methylphenoxy-p-biphenyl. For the sensitizer utilized for the thermal recording material in accordance with the present invention, bis(4-methylbenzyl)oxalate, bis(4-chlorobenzyl)oxalate, acetoacetic-o-chloroanilide, diphenylsulfone, octadecanamide, and stearic acid methylol amide are preferable.

Usually, the amount of the sensitizer is used ranging from 0.01 to 10 parts by weight per 1 part by weight of the chromogenic substance (a dye). Furthermore, when the thermal recording material in accordance with the present invention is manufactured, the above-mentioned sensitizer can be used as a raw material by fusing and mixing it together with the (poly) 4-hydroxybenzoic acid ester derivative according to the present invention, in addition to a method in which the sensitizer is used separately.

The thermal recording material in accordance with the present invention is superior in preservative stability, when a thermal recording body is made of it. An over-coated layer may be provided to add higher preservative stability, and an under-coated layer may be provided to improve chromogenic sensitivity.

With respect to the above mentioned over-coated layer, for example, light curing resin, electron curing resin, or heat curing resin is applied and cured so as to form a film; or latex or water soluble macromolecules which can form a film is coated to form the film. A bridging agent such as an epoxy compound or a curing agent may be concomitantly used. Any conventional methods may be used for coating, and a thickness of the coated layer is not limited and selected properly so as to have desired performance.

With respect to the above mentioned under-coated layer, for example, a layer in which the main components are an inorganic and/or an organic pigment with an adhesive, a layer in which the main components are a foaming filler and an adhesive, a layer in which the main components are a granular and/or a fibrous and an inorganic and/or an organic hollow material along with an adhesive, a foam layer formed with applying liquid obtained by mechanically foamed aqueous solution including water-soluble macromolecules or water-dispersed macromolecular compounds, and the like may be used. These layers employ a material having a superior adiabatic performance, and then it is possible to develop color using low energy. With respect to the under-coated layer, a coating method and a thickness of the coating layer are not limited, and selected properly so as to have desired performance.

In addition, when the thermal recording body is required to have especially high light resistance and preservative stability in a ground portion, the known hindered amine photostabilizer and/or ultraviolet absorber may be added.

Examples of the hindered amine photostabilizer are 2,2,6,6-tetramethyl-4-piperidinobenzoate, N-(2,2,6,6-tetramethyl-4-piperidino)dodecyl succinimide, 1-[(3,5-ditertiary butyl-4-hydroxyphenyl)propionyloxyethyl]-2,2,6,6-tetramethyl-4-piperidino-(3,5-ditertiary butyl-4-hydroxyphenyl)propionate, bis(2,2,6,6-tetramethyl-4-piperidino)sebacate, bis(1,2,2,6,6-pentamethyl-4-piperidino)sebacate, bis(1,2,2,6,6-pentamethyl-4-piperidino)-2-butyl-2-(3,5-ditertiary butyl-4-hydroxybenzyl)malonate, N,N,-bis(2,2,6,6-tetramethyl-4-piperidino)hexamethylenediamine, tetra(2,2,6,6-tetramethyl-4-piperidino)butanetetra carboxylate, tetra(1,2,2,6,6-pentamethyl-4-piperidino)butanetetra carboxylate, bis(2,2,6,6-tetramethyl-4-piperidino).di(tridecyl)butanetetra carboxylate, bis(1,2,2,6,6-pentamethyl-4-piperidino).di(tridecyl)butanetetra carboxylate, 3,9,-bis[1,1-dimethyl-2-{tris(2,2,6,6-tetramethyl-4-piperidinoxy carbonyloxy) butylcarbonyloxy}ethyl]-2,4,8,10-tetraoxyspiro[5.5] undecane, 3,9-bis[1,1-dimethyl-2-{tris(1,2,2,6,6-pentamethyl-4-piperidinoxy carbonyloxy) butylcarbonyloxy}ethyl]-2,4,8,10-tetraoxyspiro[5.5] undecane, 1,5,8,12-tetrakis[4,6-bis{N-(2,2,6,6-tetramethyl-4-piperidino)butylamino}-1,3,5-triazine-2-yl]-1,5,8,12-tetraazadodecane, 1-(2-hydroxyethyl)-2,2,6,6-tetramethyl-4-piperidinol/dimethyl succinate condensation product, 2-tertiary octylamino-4,6-dicyclo-s-triazine/N,N-bis(2,2,6, 6-tetramethyl-4-piperidino)hexamethylenediamine condensation product, N,N-bis(2,2,6,6-tetramethyl-4-piperidino) hexamethylenediamine/dibromoethane condensation product, and the like.

Examples of the ultraviolet absorber are 2-hydroxybenzophenones such as 2,4-dihydroxybenzophenone, 2-hydroxy-4-methoxybenzophenone, 2-hydroxy-4-octoxybenzophenone, and 5,5'-methylene bis(2-hydroxy-4-methoxybenzophenone); 2-(2-hydroxyphenyl) benzotriazoles such as 2-(2-hydroxy-5-methylphenyl) benzotriazole, 2-(2-hydroxy-5-tertiaryoctylphenyl) benzotriazol, 2-(2-hydroxy-3,5-ditertiarybutylphenyl)-5-chlorobenzotriazole, 2-(2-hydroxy-3-tertiarybutyl-5-methylphenyl)-5-chlorobenzotriazole, 2-(2-hydroxy-3,5-dicumylphenyl)benzotriazole, 2,2'-methylene bis(4-tertiaryoctyl-6-benzotriazolylphenol), polyethylene glycol ester of 2-(2-hydroxy-3-tertiarybutyl-5-carboxyphenol) benzole, 2-[2-hydroxy-3-(2-acryloyloxyethyl)-5-methylphenyl]benzotriazole, 2-[2-hydroxy-3-(2-methacryloyloxyethyl)-5-tertiary butylphenyl] benzotriazole, 2-[2-hydroxy-3-(2-methacryloyloxyethyl)-5-tertiary butylphenyl]benzotriazole, 2-[2-hydroxy-3-(2-methacryloyloxyethyl)-5-tertiary butylphenyl]-5-chlorobenzotriazole, 2-[2-hydroxy-5-(2-methacryloyloxyethyl)phenyl]benzotriazole, 2-[2-hydroxy-3-tertiary butyl-5-(2-methacryloyloxyethyl)phenyl] benzotriazole, 2-[2-hydroxy-3-tertiary amyl-5-(2-methacryloyloxyethyl)phenyl]benzotriazole, 2-[2-hydroxy-3-tertiary butyl-5-(3-methacryloyloyloxypropyl)phenyl]-5-chlorobenzotriazole, 2-[2-hydroxy-4-(2-methacryloyloxymethyl)phenyl]benzotriazole, 2-[2-hydroxy-4-(3-methacryloyloxy-2-hydroxypropyl)phenyl] benzotriazole, and 2-[2-hydroxy-4-(3-methacryloyloxypropyl)phenyl]benzotriazole; 2-(2-hydroxyphenyl)-4,6-diaryl-1,3,5-triazines such as 2-(2-hydroxy-4-methoxy phenyl)-4,6-diphenyl-1,3,5-triazine, 2-(2-hydroxy-4-hexyloxyphenyl)-4,6-diphenyl-1,3,5-triazine, 2-(2-hydroxy-4-octoxyphenyl)-4,6-bis(2,4-dimethylphenyl)-1,3,5-triazine, 2-(2-hydroxy-4-(3-Carbon from 12 to 13 mixed alkoxy-2-hydroxypropoxy) phenyl]-4,6-bis(2,4-dimethylphenyl)-1,3,5-triazine, 2-[2-hydroxy-4-(2-acryloyloxyethoxy)phenyl]-4,6-bis(4-methylphenyl)-1,3,5-triazine, 2-(2,4-dihydroxy-3-allylphenyl)-4,6-bis(2,4-dimethylphenyl)-1,3,5-triazine, and 2,4,6-tris(2-hydroxy-3-methyl-4-hexyloxyphenyl)-1,3,5-triazine; benzoates such as phenylsalicylate, resorcinolmonobenzoate, 2,4-ditertiary butylphenyl-3,5-ditertiary butyl-4-hydroxybenzoate, and hexadecyl-3,5-ditertiary butyl-4-hydroxybenzoate; substitution oxanilides such as 2-ethyl-2'-ethoxyoxanilide, and 2-ethoxy-4'-dodecyloxanilide; cyanoacrylates such as ethyl-α-cyano-β, β-diphenylacrylate, and methyl-2-cyano-3-methyl-3-(p-methoxyphenyl)acrylate; and a variety of metal salts or metal chelates. Above all, nickel or chrome salt, or chelates are illustrated, and 2-(2-hydroxyphenyl) benzotriazoles are especially preferable.

The additive amount of the photostabilizer or the ultraviolet absorber is preferably ranging from 0.01 to 10 parts by weight per 1 part by weight of the chromogenic substance (the dye). More preferably, it is ranging from 0.05 to 5 parts by weight. When its amount is at a part by weight of less than 0.01, the stabilizing effect may not be sufficient. In addition, when it is at a part by weight of more than 10, its effect may not increase, and it may rather badly influence features of a applying film, so that it is not preferable. Furthermore, when the chromogenic portion is required to have especially high preservative stability, the known preservative stabilizer may be concomitantly used as needed.

The preservative stabilizer which may be used for the thermal recording material in accordance with the present invention as needed are, for example, hindered phenols such as 1,1,3-tris(2-methyl-4-hydroxy-5-tertiary butyl phenyl) butane, 1,1,3-tris(2-methyl-4-hydroxy-5-cyclohexylphenyl) butane, 4,4'-butylidene bis(2-tertiary butyl-5-methylphenol), 4,4'-thiobis(2-tertiary butyl-5-methylphenol), 2,2'-thiobis(6-tertiary butyl-4-methylphenol), and 2,2'-methylenebis(6-tertiary butyl-4-methylphenol); 4-benzyloxy-4'-(2-methylglycidyloxy) diphenylsulfone; sodium-2,2'-methylenebis(4,6-ditertiary butyl phenyl)phosphate; and the like. Usually, the amount of the preservative stabilizer is preferably ranging from 0.01 to 10 parts by weight per 1 part by weight of the chromogenic substance (the dye).

In addition, the thermal recording material in accordance with the present invention may concomitantly use a chelate color developer which consists of an aliphatic ferric iron as needed.

Applying Liquid

A (poly) 4-hydroxybenzoic acid ester derivative, and a chromogenic substance (a dye) used for the present invention, and a developer, a sensitizer, and a preservative stabilizer which are used for this invention as needed are usually to become fine particles by a triturator such as a ball mill, an attritor, and a sand grinder, or a proper emulsifier. Then, a variety of additives are further added according to their objects to prepare applying liquid.

Usually, a binder such as polyvinyl alcohol, hydroxyethyl cellulose, methyl cellulose, polyvinylpyrolidone, polyacrylamide, starches, styrene-maleic anhydride copolymer, vinyl acetate-maleic anhydride copolymer, styrene-butadiene copolymer, or denaturated substances thereof; and a filler such as kaoline, silica, diatom earth, titanium dioxide, calcium carbonate, magnesium carbonate, aluminum hydroxide, or melamine are added to the above described applying liquid. In addition, metal soaps, amides, waxes, photostabilizers, waterproofers, dispersing agents, defoaming agents, and the like may be used as needed.

Manufacturing a Thermal Recording Material

A desired thermal recording material can be obtained by applying the above described applying liquid on paper or a variety of films. Then, the obtained thermal recording material can be utilized for papers for facsimile and printer, labels, price tags, tickets, and the like.

EXAMPLES

The present invention will be described in detail with reference to the following Manufacturing Examples and Examples, but is not intended to be limited to these Manufacturing Examples and Examples.

A (poly) 4-hydroxybenzoic acid ester derivative in accordance with the present invention can be easily manufactured by a condensation reaction of a carboxylic acid component which includes a (poly) 4-hydroxybenzoic acid as an essential component, a monocarboxylic acid and/or a dicarboxylic acid (as reaction materials, reactive derivatives such as an acid anhydride, an acid halide, and a lower alkyl ester may be used.) with a polyhydric alcohol component which includes a trihydric or more alcohol as an essential component, and a dihydric low molecular-weight alcohol as an arbitrary component.

The poly 4-hydroxybenzoic acid (the letter p is 1 or 2 in the general formula (I)) is considered to be generated during the reaction by using 4-hydroxybenzoic acid, depending on reaction conditions. The poly 4-hydroxybenzoic acid may be preliminarily synthesized and used. Therefore, in this specification, a term of poly 4-hydroxybenzoic acid as a raw material includes a case which poly 4-hydroxybenzoic acid is used, and another case in which 4-hydroxybenzoic acid bonded to a polyhydric alcohol via the esterification reaction, further reacts with the 4-hydroxybenzoic acid via esterification reaction to eventually produce the poly 4-hydroxybenzoic acid.

The condensation reaction is not particular one, but the known conventional ones. The reaction material may be added all at once, or may be serially added. A polyhydric alcohol condensation product such as polypentaerythrithol, polytrimethylolepropane can be obtained by condensation reaction in the presence of a conventional acid catalyst used for the polyhydric alcohol. However, the esterification reaction and the condensation reaction can be simultaneously conducted.

Manufacturing Example 1

A Synthesis of Compound NO.1

12.7 g of dipentaerythritol, 48.4 g of 4-hydroxybenzoic acid, and 0.43 g of tetraisopropoxy titanate were loaded into a 100 ml capacity round bottom flask and allowed to react at a temperature of 210° C. for four hours. After cooling, the product was dissolved in 300 mL of ethyl acetate, washed with water, and oil and the water were separated. After removing the solvent by distilling, the residue was dissolved in 50 g of ethanol. Then, activated carbon and silica gel were added so as to adsorb impurities. Solution in which the activated carbon and the silica gel were removed by filtration was added dropwise to 150 g of toluene so as to separate a crystal, and 39.98 g of a white crystal was obtained (yield 82%).

Manufacturing Example 2

A Synthesis of Compound NO.2

10.17 g of dipentaerythritol, 18.24 g of methyl 4-hydroxybenzoate, 16.32 g of methyl benzoate and 0.34 g of tetraisopropoxy titanate were loaded into a 100 ml capacity round bottom flask and allowed to react at a temperature of 210° C. for four hours with removing generated methanol by distilling. After cooling, the product was dissolved in 250 mL of ethyl acetate, washed with water, and oil and the water were separated. After removing the solvent by distilling, the residue was dissolved in 45 g of ethanol. Then, activated carbon and silica gel were added so as to adsorb impurities. Solution in which the activated carbon and the silica gel were removed by filtration was added dropwise to 150 g of toluene so as to separate a crystal, and 27.12 g of a white crystal, that is, Compound NO.2 was obtained (yield 73.1%).

Manufacturing Example 3

A Synthesis of Compound NO.11

55.25 g of 4-hydroxybenzoic acid, 45.39 g of DDC (dicyclohexylcarbodiimide) and 200 mL of ethyl acetate were loaded into a 500 ml capacity round bottom flask and allowed to react at a temperature of 77° C. for two hours in a stream of nitrogen. After cooling, precipitate was removed by filtration and solvent was removed by distilling, so that a crude crystal was obtained. This crude crystal was purified using silica gel in which mixed solvent of hexane: ethyl acetate=8:2 is used as a mobile phase. 26.05 g of 4-hydroxybenzoic acid (4'-carboxy) phenyl which is an intermediate was obtained (yield 50.5%).

Then, 26.05 g of the obtained 4-hydroxybenzoic acid (4'-carboxy) phenyl, 4.32 g of dipentaerythritol, 0.3 g of p-toluenesulfonic acid, and 30 g of 4-methyl anisole were loaded and allowed to react at a temperature of 175° C. for three hours in a stream of nitrogen. After confirming that 1.9 g of water was eluted in a water separating apparatus, the product was cooled. After cooling, it was dissolved in 100 mL of ethyl acetate, and washed with 80 mL of dilute alkaline water three times and 80 mL of water three times, and then oil and the water were separated. After removing an organic layer and removing the solvent by distilling, the residue was dissolved in 150 g of ethanol. Then, activated carbon and silica gel were added so as to adsorb impurities. The activated carbon and the silica gel were removed by filtration and the solvent was removed by distilling, so that a solid was obtained. The solid was ground and obtained 19.6 g of a slightly yellowish white powder of Compound No.11 (yield 68%).

Manufacturing Example 4

A Synthesis of Compound NO.16

12.7 g of dipentaerythritol, 62.15 g of 4-hydroxybenzoic acid, 0.1 g of sulfuric acid and 50 g of 4-methylanisole were loaded into a 200 ml capacity round bottom flask and allowed to react at a temperature of 175° C. for three hours in a stream of nitrogen. After confirming that 8.1 g of water was eluted in a water separating apparatus, the product was cooled. After cooling, it was dissolved in 150 mL of ethyl acetate, and washed with 100 mL of dilute alkaline water three times and 100 mL of water three times, and then oil and the water were separated. After removing an organic layer and removing the solvent by distilling, the residue was dissolved in 300 g of ethanol. Then, activated carbon and silica gel were added so as to adsorb impurities. The activated carbon and the silica gel were removed by filtration and the solvent was removed by distilling, so that a solid was obtained. The solid was ground and obtained 50.10 g of a slightly yellowish white powder of Compound No.16 (yield 75%).

Manufacturing Example 5

A Synthesis of Compound NO.23 (in Table 1)

10.0 g of tetrapentaerythritol, 31.4 g of 4-hydroxymethyl benzoate, and 0.3 g of tetraisopropoxy titanate were loaded into a 100 ml capacity round bottom flask and allowed to react at a temperature of 210° C. for four hours with removing generated methanol by distilling. After cooling, the product was dissolved in 300 mL of ethyl acetate, washed with water, and oil and the water were separated. After removing the solvent by distilling, the residue was dissolved in 50 g of ethanol. Then, activated carbon and silica gel were added so as to adsorb impurities. Solution in which the activated carbon and the silica gel were removed by filtration was added dropwise to 150 g of toluene so as to separate a crystal, and 27.8 g of a white crystal, that is, Compound No.23 was obtained (yield 80.0 percent by weight). Features of the crystal are as follows. Softening point: about 115° C. (peak top temperature by DTA), IR absorption wave number: 1715 $cm^{-1}$, 1320 $cm^{-1}$, and 1100 $cm^{-1}$ (derived from aromatic ester); 1380 $cm^{-1}$ and 620 $cm^{-1}$ (derived from phenols); and 1110 $cm^{-1}$ (derived from ether).

Manufacturing Example 6

A Synthesis of Compound NO.28 (in Table 2)

10.0 g of hexapentaerythritol, 12.6 g of 4-hydroxymethyl benzoate, 15.4 g of 3-chloro-4-hydroxymethyl benzoate, and 0.3 g of tetraisopropoxy titanate were loaded into a 100 ml capacity round bottom flask and allowed to react at a temperature of 210° C. for four hours with removing generated methanol by distilling. After cooling, the product was dissolved in 270 ml of ethyl acetate, washed with water, and oil and the water were separated. After removing the solvent by distilling, the residue was dissolved in 50 g of ethanol. Then, activated carbon and silica gel were added so as to adsorb impurities. Solution in which the activated carbon and the silica gel were removed by filtration was added dropwise to 150 g of toluene so as to separate a crystal, and 24.2 g of a white crystal, that is, Compound NO.28 was obtained (yield 74.1 percent by weight). Features of the crystal are as follows. Softening point: about 134° C. (peak top temperature by DTA), IR absorption wave number: 1715 $cm^{-1}$, 1320 $cm^{-1}$, and 1100 $cm^{-1}$ (derived from aromatic ester); 1380 $cm^{-1}$ and 620 $cm^{-1}$ (derived from phenols); 1110 $cm^{-1}$ (derived from ether); and 1020 $cm^{-1}$ (derived from chlorobenzene).

Manufacturing Example 7

A Synthesis of Compound NO.32 (in Table 3)

12.0 g of decapentaerythritol, 20.7 g of 4-hydroxybenzoic acid, 10.1 g of 2-ethylhexanoic acid, 0.3 g of p-toluenesulfonic acid, and 50 g of 4-methylanisole were loaded into a 200 ml capacity round bottom flask and allowed to react at a temperature of 175° C. for three hours. After confirming that 4.0 g of water was eluted in a water separating apparatus, the product was cooled. After cooling, it was dissolved in 300 mL of ethyl acetate, and washed with water, and then oil and the water were separated. After removing the solvent by distilling, the residue was dissolved in 50 g of ethanol. Then, activated carbon and silica gel were added so as to adsorb impurities. The activated carbon and the silica gel were removed by filtration. Solution in which the activated carbon and the silica gel were removed by filtration was added dropwise to 150 g of toluene so as to separate a crystal, and 27.4 g of a white crystal, that is, Compound NO.32 was obtained (yield 70.9 percent by weight). Features of the crystal are as follows. Softening point: about 170° C. (peak top temperature by DTA), IR absorption wave number: 1715 $cm^{-1}$, 1320 $cm^{-1}$, and 1100 $cm^{-1}$ (derived from aromatic ester); 1725 $cm^{-1}$ and 1160 $cm^{-1}$ (derived from aliphatic ester); 1380 $cm^{-1}$ and 620 $cm^{-1}$ (derived from phenols); 1110 $cm^{-1}$ (derived from ether); and 2950 $cm^{-1}$ and 2870 $cm^{-1}$ (derived from 1-ethylpentyl group).

Manufacturing Example 8

A Synthesis of Compound NO.38 (in Table 4)

10.9 g of pentaerythritol, 49.8 g of 4-hydroxybenzoic acid, 3.3 g of terephthalic acid, 2.49 g of ethylene glycol, 118.5 g of Solvesso 150™ (manufactured by Esso Petroleum Co., an aromatic solvent), and 0.12 g of sulfuric acid were loaded into a 300 ml capacity round bottom flask and allowed to react at a temperature of 190° C. for six hours with removing generated water by distilling.

After confirming that 6.5 g of water was eluted, the product was cooled. Then, 88.9 g of diethylene glycol diethyl ether and 0.5 g of KYOWAAD 500™ (manufactured by Kyowa Chemical Industry Ltd., acid adsorbent: $Mg_6Al_2(OH)_{16}CO_3.4H_2O$) were added and stirred for 30 minutes. After separated KYOWAAD 500 by filtration, the solvent was removed and the product was ground, so that 48.7 g of a slightly yellowish crystal of Compound No.38 was obtained. Features of the crystal are as follows. Softening point: about 97° C. (peak top temperature by DTA), IR absorption wave number: 1715 $cm^{-1}$, 1315 $cm^{-1}$, and 1100 $cm^{-1}$ (derived from aromatic ester); 1380 $cm^{-1}$ and 620 $cm^{-1}$ (derived from phenols); 1110 $cm^{-1}$ (derived from ether); and 2960 $cm^{-1}$ and 2880 $cm^{-1}$ (derived from ethylene).

Manufacturing Example 9

A Synthesis of Compound NO.42 (in Table 4)

2.7 g of trimethylolpropane, 5.1 g of terephthalic acid bis(2-hydroxyethyl), 0.04 g of titanium tetraisopropoxide as a catalyst of on ester-exchange, and 20.0 g of Solvesso 150 (manufactured by Esso Petroleum Co., an aromatic solvent) were loaded into a 300 ml capacity round bottom flask and was stirred with removing generated ethylene glycol at a temperature of 150° C. for two hours. After confirming that 1.24 g of ethylene glycol was eluted and the product was cooled to about room temperature, 70 g of Solvesso 150, 38.7 g of of 4-hydroxybenzoic acid, 8.0 g of trimethylolpropane, and 0.092 g of sulfuric acid were loaded and allowed to react at a temperature of 190° C. for six hours with removing generated water by distilling. After confirming that 5.1 g of water was eluted, the product was cooled. Then, 74.2 g of diethylene glycol diethyl ether and 0.4 g of KYOWAAD 500 (manufactured by Kyowa Chemical Industry Ltd., acid adsorbent: $Mg_6Al_2(OH)_{16}CO_3.4H_2O$) were added and stirred for 30 minutes. After separation of KYOWAAD 500 by filtration, the solvent was removed and the product was ground, so that 40.3 g of a slightly yellowish crystal of Compound No.42 was obtained. Features of the crystal are as follows. Softening point: about 78° C. (peak top temperature by DTA), IR absorption wave number: 1715 $cm^{-1}$, 1315 $cm^{-1}$, and 1100 $cm^{-1}$ (derived from aromatic ester); 1380 $cm^{-1}$ and 620 $cm^{-1}$ (derived from phenols); 1110 $cm^{-1}$ (derived from ether); and 2960 $cm^{-1}$ and 2880 $cm^{-1}$ (derived from ethylene).

Manufacturing Example 10

A Synthesis of Compound NO.45 (in Table 4)

10.2 g of dipentaerythritol, 38.7 g of 4-hydroxybenzoic acid, 3.3 g of terephthalic acid, 2.9 g of 2-ethylhexanoic acid, 200 g of Solvesso 150 (manufactured by Esso Petroleum Co., a trademark of an aromatic solvent), and 0.10 g of sulfuric acid were loaded into a 300 ml capacity round bottom flask and allowed to react at a temperature of 190° C. for six hours with removing generated water by distilling. After confirming that 5.0 g of water was eluted, the product was cooled. Then, 90 g of diethylene glycol diethyl ether and 0.4 g of KYOWAAD 500 (manufactured by Kyowa Chemical Industry Ltd., $Mg_6Al_2(OH)_{16}CO_3.4H_2O$) were added and stirred for 30 minutes. After KYOWAAD 500 was separated by filtration, the solvent was removed and the product was ground, so that 33.2 g of a slightly yellowish crystal of Compound No.45 was obtained. Features of the crystal are as follows. Softening point: about 92° C. (peak top temperature by DTA), IR absorption wave number: 1715 $cm^{-1}$, 1315 $cm^{-1}$, and 1100 $cm^{-1}$ (derived from aromatic ester); 1380 $cm^{-1}$ and 620 $cm^{-1}$ (derived from phenols); 1110 $cm^{-1}$ (derived from ether); and 2950 $cm^{-1}$ and 2870 $cm^{-1}$ (derived from 1-ethylpentyl group).

Manufacturing Example 11

A Synthesis of Compound NO.46 (in Table 4)

17.0 g of hexapentaerythritol, 72.0 g of 4-hydroxybenzoic acid, 1.6 g of terephthalic acid, 200 g of Solvesso 150 (manufactured by Esso Petroleum Co., an aromatic solvent), and 0.22 g of sulfuric acid were loaded into a 500 ml capacity round bottom flask and allowed to react at a temperature of 190° C. for six hours with removing generated water by distilling. After confirming that 12.2 g of water was eluted, the product was cooled. Then, 140 g of diethylene glycol diethyl ether and KYOWAAD 500 (manufactured by Kyowa Chemical Industry Ltd., acid adsorbent: $Mg_6Al_2(OH)_{16}CO_3.4H_2O$) were added and stirred for 30 minutes. After KYOWAAD 500 was separated by filtration, the solvent was removed and the product was ground, so that 77.2 g of a slightly yellowish crystal of Compound No.46 was obtained. Features of the crystal are as follows. Softening point: about 134° C. (peak top temperature by DTA), IR absorption wave number: 1715 $cm^{-1}$, 1315 $cm^{-1}$, and 1100 $cm^{-1}$ (derived from aromatic ester); 1380 $cm^{-1}$ and 620 $cm^{-1}$ (derived from phenols); and 1110 $cm^{-1}$ (derived from ether).

Example 1

Twenty g of 3-(N,N-dibutylamino)-6-methyl-7-anilinofluoran and 100 g of 10% polyvinyl alcohol aqueous solution were sufficiently ground in a ball mill, so that a dispersing solution A was obtained. Then, 20 g of bis(4-methylbenzyl)oxalate and 100 g of 10% polyvinyl alcohol aqueous solution were sufficiently ground in a ball mill, so that a dispersing solution B was obtained. Twenty g of the sample compound (Table 5) and 100 g of 10% polyvinyl alcohol aqueous solution were sufficiently ground in a ball mill to obtain a dispersing solution C.

The above described dispersing solutions A, B, and C were mixed at a ratio by weight of 1:2:2. Then, 50 g of calcium carbonate was added to 200 g of the mixed solution and was sufficiently dispersed so as to prepare applying liquid. This applying liquid was applied on a base paper with 50 g/$m^2$ at a thickness of 32 $\mu$m and dried, so that a thermal recording material was obtained.

A chromogenic concentration of a recording image printed at a pulse width of 0.8 msec by the use of the obtained thermal recording material and a thermal printing apparatus (TH-PMD: manufactured by Ookuradennki Co.), and a concentration of a ground portion (an initial concentration) were measured with a Macbeth densitometer (manufactured by Macbeth Co. RD-933 type). A thermal recording body which was thus obtained by developing colors of the thermal recording material was stored at a temperature of 60° C. under dry condition for 24 hours. Then, changes in the concentration of the ground portion and the chromogenic portion were measured to estimate the preservative stability against heat.

In addition, after the obtained thermal recording body was put into a carbon arc fadeometer and radiated for six hours, the concentration of the printing portion was measured to estimate the preservative stability against light was estimated. The concentration of the ground portion was also measured using a yellow filter.

Furthermore, after dioctylphthalate was stamped on the printing portion obtained by developing colors and on the ground portion of the thermal recording body, it was stored at a temperature of 40° C. under dry condition for 24 hours. Then, changes in the concentration were measured, so that the oil resistance was estimated. These results were shown in the following Table 5.

TABLE 5

| NO. | Sample compound | Concentration | Initial concentration | Preservative stability (Concentration) Heat resistance | Light resistance | Oil resistance |
|---|---|---|---|---|---|---|
| Comparative example | | | | | | |
| 1-1 | Comparative compound 1 | Printing portion | 1.28 | 0.98 | 0.90 | 0.59 |
| | | Ground portion | 0.07 | 0.12 | 0.16 | 0.09 |
| 1-2 | Comparative compound 2 | Printing portion | 1.27 | 1.01 | 0.92 | 0.61 |
| | | Ground portion | 0.07 | 0.11 | 0.15 | 0.09 |
| Example | | | | | | |
| 1-1 | Compound No. 1 | Printing portion | 1.31 | 1.25 | 1.18 | 1.24 |
| | | Ground portion | 0.05 | 0.06 | 0.06 | 0.08 |
| 1-2 | Compound No. 2 | Printing portion | 1.27 | 1.21 | 1.12 | 1.22 |
| | | Ground portion | 0.05 | 0.06 | 0.06 | 0.08 |
| 1-3 | Compound No. 3 | Printing portion | 1.28 | 1.22 | 1.15 | 1.23 |
| | | Ground portion | 0.05 | 0.06 | 0.06 | 0.07 |
| 1-4 | Compound No. 4 | Printing portion | 1.30 | 1.24 | 1.16 | 1.23 |
| | | Ground portion | 0.06 | 0.06 | 0.06 | 0.08 |
| 1-5 | Compound No. 5 | Printing portion | 1.25 | 1.19 | 1.09 | 1.21 |
| | | Ground portion | 0.05 | 0.05 | 0.06 | 0.07 |
| 1-6 | Compound No. 6 | Printing portion | 1.24 | 1.18 | 1.06 | 1.18 |
| | | Ground portion | 0.06 | 0.07 | 0.07 | 0.08 |
| 1-7 | Compound No. 7 | Printing portion | 1.30 | 1.21 | 1.12 | 1.22 |
| | | Ground portion | 0.06 | 0.07 | 0.07 | 0.08 |
| 1-8 | Compound No. 8 | Printing portion | 1.28 | 1.20 | 1.10 | 1.19 |
| | | Ground portion | 0.06 | 0.07 | 0.07 | 0.08 |
| 1-9 | Compound No. 9 | Printing portion | 1.23 | 1.19 | 1.10 | 1.13 |
| | | Ground portion | 0.05 | 0.06 | 0.06 | 0.07 |
| 1-10 | Compound No. 10 | Printing portion | 1.27 | 1.18 | 1.11 | 1.13 |
| | | Ground portion | 0.05 | 0.07 | 0.06 | 0.08 |

Comparative Compound 1

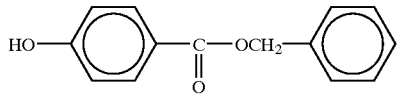

Comparative Compound 2

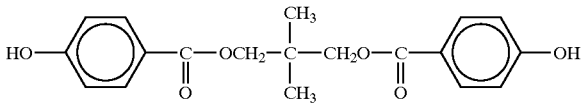

Example 2

Twenty g of 3-(N,N-dibutylamino)-6-methyl-7-anilinofluoran and 100 g of 10% polyvinyl alcohol aqueous solution were sufficiently ground in a ball mill, so that a dispersing solution A was obtained. Then, 20 g of bis(4-methylbenzyl)oxalate and 100 g of 10% polyvinyl alcohol aqueous solution were sufficiently ground in a ball mill, so that a dispersing solution B was obtained. Twenty g of the sample compound (Table 6) and 100 g of 10% polyvinyl alcohol aqueous solution were sufficiently ground in a ball mill, so that a dispersing solution C was obtained.

The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained.

A chromogenic concentration of a recording image printed at a pulse width of 0.8 msec in which the obtained thermal recording material and a thermal printing apparatus (TH-PMD: manufactured by Ookuradennki Co.) were used, and a concentration of a ground portion (an initial concentration) were measured with a Macbeth densitometer (manufactured by Macbeth Co. RD-933 type). A thermal recording body which was obtained by developing colors of the thermal recording material was stored at a temperature of 60° C. under dry condition for 24 hours. Then, changes in the concentration of the ground portion and the chromogenic portion were measured to estimate the preservative stability against heat. After the thermal recording body was also put into a carbon arc fadeometer and radiated for six hours, the concentration of the printing portion was measured to estimate the preservative stability against light. The concentration of the ground portion was also measured using a yellow filter.

Furthermore, after dioctylphthalate was stamped on the printing portion obtained by developing colors and the ground portion of the thermal recording body, it was stored at a temperature of 40° C. under dry condition for 24 hours. Then, changes in the concentration were measured, so that oil resistance was estimated. These results were shown in the following Table 6.

TABLE 6

| NO. | Sample compound | Concentration | Initial concentration | Preservative stability (Concentration) Heat resistance | Light resistance | Oil resistance |
|---|---|---|---|---|---|---|
| Comparative example | | | | | | |
| 2-1 | Comparative compound 3 | Printing portion | 1.27 | 0.98 | 0.91 | 0.60 |
| | | Ground portion | 0.07 | 0.12 | 0.16 | 0.09 |
| 2-2 | Comparative compound 4 | Printing portion | 1.24 | 1.00 | 0.92 | 0.61 |
| | | Ground portion | 0.07 | 0.11 | 0.15 | 0.09 |
| Example | | | | | | |
| 2-1 | Compound No. 11 | Printing portion | 1.28 | 1.23 | 1.16 | 1.24 |
| | | Ground portion | 0.05 | 0.06 | 0.06 | 0.08 |
| 2-2 | Compound No. 12 | Printing portion | 1.30 | 1.25 | 1.18 | 1.24 |
| | | Ground portion | 0.05 | 0.06 | 0.06 | 0.08 |
| 2-3 | Compound No. 13 | Printing portion | 1.30 | 1.21 | 1.12 | 1.22 |
| | | Ground portion | 0.05 | 0.06 | 0.06 | 0.08 |
| 2-4 | Compound No. 14 | Printing portion | 1.29 | 1.24 | 1.15 | 1.22 |
| | | Ground portion | 0.06 | 0.06 | 0.06 | 0.08 |
| 2-5 | Compound No. 15 | Printing portion | 1.26 | 1.19 | 1.09 | 1.21 |
| | | Ground portion | 0.05 | 0.06 | 0.06 | 0.07 |
| 2-6 | Compound No. 16 | Printing portion | 1.27 | 1.25 | 1.16 | 1.25 |
| | | Ground portion | 0.06 | 0.06 | 0.06 | 0.07 |

Comparative Compound 3

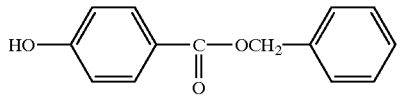

Comparative Compound 4

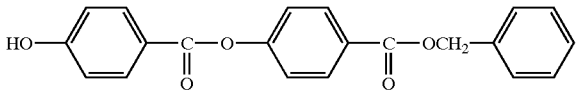

Example 3

Twenty g of 3-(N-ethyl-N-isoamylamino)-6-methyl-7-anilinofluoran and 100 g of 10% polyvinyl alcohol aqueous solution were sufficiently ground in a ball mill, so that a dispersing solution A was obtained. Then, 20 g of diphenylsulfonic acid and 100 g of 10% polyvinyl alcohol aqueous solution were sufficiently ground in a ball mill, so that a dispersing solution B was obtained. Twenty g of the sample compound (Table 7) and 100 g of 10% polyvinyl alcohol aqueous solution were sufficiently ground in a ball mill, so that a dispersing solution C was obtained.

The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained. Using the obtained thermal recording material, the test was performed in the same manner as in Example 2. The results were shown in the following Table 7.

TABLE 7

| NO. | Sample compound | Concentration | Initial concentration | Preservative stability (Concentration) Heat resistance | Light resistance | Oil resistance |
|---|---|---|---|---|---|---|
| Comparative example | | | | | | |
| 3-1 | Comparative compound 3 | Printing portion | 1.28 | 0.98 | 0.90 | 0.60 |
| | | Ground portion | 0.07 | 0.13 | 0.15 | 0.08 |
| 3-2 | Comparative compound 4 | Printing portion | 1.27 | 1.02 | 0.93 | 0.62 |
| | | Ground portion | 0.07 | 0.11 | 0.14 | 0.08 |
| Example | | | | | | |
| 3-1 | Compound No. 11 | Printing portion | 1.30 | 1.24 | 1.16 | 1.25 |
| | | Ground portion | 0.05 | 0.06 | 0.06 | 0.08 |
| 3-2 | Compound No. 12 | Printing portion | 1.31 | 1.25 | 1.20 | 1.24 |
| | | Ground portion | 0.05 | 0.06 | 0.06 | 0.08 |
| 3-3 | Compound No. 13 | Printing portion | 1.30 | 1.23 | 1.12 | 1.22 |
| | | Ground portion | 0.05 | 0.06 | 0.06 | 0.08 |
| 3-4 | Compound No. 14 | Printing portion | 1.29 | 1.25 | 1.15 | 1.22 |
| | | Ground portion | 0.06 | 0.06 | 0.06 | 0.08 |
| 3-5 | Compound No. 15 | Printing portion | 1.28 | 1.19 | 1.10 | 1.21 |
| | | Ground portion | 0.05 | 0.06 | 0.06 | 0.07 |
| 3-6 | Compound No. 16 | Printing portion | 1.28 | 1.25 | 1.16 | 1.25 |
| | | Ground portion | 0.06 | 0.06 | 0.06 | 0.07 |

Example 4

Twenty g of 3-(N,N-dibutylamino)-6-methyl-7-anilinofluoran and 100 g of 10 percent by weight polyvinyl alcohol aqueous solution were sufficiently ground in a ball mill, so that a dispersing solution A was obtained. Then, 20 g of bis(4-methylbenzyl)oxalate and 100 g of 10 percent by weight polyvinyl alcohol aqueous solution were sufficiently ground in a ball mill, so that a dispersing solution B was obtained. Twenty g of the sample compound (Table 8) and 100 g of 10% polyvinyl alcohol aqueous solution were sufficiently ground in a ball mill, so that a dispersing solution C was obtained. The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained.

A chromogenic concentration of a recording image printed at a pulse width of 0.8 msec using the obtained thermal recording material and a thermal printing apparatus (TH-PMD: manufactured by Ookuradennki Co.), and a concentration of a ground portion (an initial concentration) were measured with a Macbeth densitometer (manufactured by Macbeth Co. RD-933 type). With respect to a thermal recording body which was obtained by developing colors of the thermal recording material, a preservative stability against heat test (storage at a temperature of 60° C. under dry condition for 24 hours), a preservative stability against light test (radiation for six hours in a carbon arc fadeometer), and a preservative stability against oil test (after stamping dioctylphthalate on the printing portion and the ground portion of the thermal recording body, it was stored at a temperature of 40° C. under dry condition for 24 hours.) were performed. Then, changes in the concentration of the printing portion and the ground portion were measured. The concentration of the ground portion was also measured using a yellow filter at the preservative stability against light test. These results were shown in the following Table 8.

TABLE 8

| NO. | Sample compound | Concentration | Initial concentration | Preservative stability (Concentration) Heat resistance | Light resistance | Oil resistance |
|---|---|---|---|---|---|---|
| Comparative example | | | | | | |
| 4-1 | Comparative compound 5 | Printing portion | 1.27 | 0.98 | 0.91 | 0.60 |
| | | Ground portion | 0.07 | 0.12 | 0.16 | 0.09 |
| 4-1 | Comparative compound 6 | Printing portion | 1.24 | 1.00 | 0.92 | 0.61 |
| | | Ground portion | 0.07 | 0.11 | 0.15 | 0.09 |

TABLE 8-continued

| NO. | Sample compound | Concentration | Initial concentration | Preservative stability (Concentration) Heat resistance | Light resistance | Oil resistance |
|---|---|---|---|---|---|---|
| Example | | | | | | |
| 4-1 | Compound No. 17 | Printing portion | 1.11 | 1.04 | 1.10 | 0.94 |
| | | Ground portion | 0.05 | 0.06 | 0.06 | 0.08 |
| 4-2 | Compound No. 19 | Printing portion | 1.27 | 1.21 | 1.12 | 1.22 |
| | | Ground portion | 0.05 | 0.07 | 0.08 | 0.09 |
| 4-3 | Compound No. 21 | Printing portion | 1.28 | 1.22 | 1.15 | 1.23 |
| | | Ground portion | 0.05 | 0.06 | 0.06 | 0.07 |
| 4-4 | Compound No. 22 | Printing portion | 1.30 | 1.24 | 1.19 | 1.23 |
| | | Ground portion | 0.06 | 0.06 | 0.06 | 0.07 |
| 4-5 | Compound No. 23 | Printing portion | 1.25 | 1.21 | 1.20 | 1.21 |
| | | Ground portion | 0.05 | 0.05 | 0.06 | 0.06 |
| 4-6 | Compound No. 25 | Printing portion | 1.14 | 1.01 | 0.99 | 1.00 |
| | | Ground portion | 0.06 | 0.07 | 0.07 | 0.08 |
| 4-7 | Compound No. 27 | Printing portion | 1.11 | 1.02 | 0.96 | 0.96 |
| | | Ground portion | 0.06 | 0.07 | 0.07 | 0.08 |
| 4-8 | Compound No. 29 | Printing portion | 1.28 | 1.20 | 1.10 | 1.19 |
| | | Ground portion | 0.06 | 0.07 | 0.07 | 0.08 |
| 4-9 | Compound No. 30 | Printing portion | 1.23 | 1.19 | 1.13 | 1.15 |
| | | Ground portion | 0.05 | 0.06 | 0.06 | 0.07 |
| 4-10 | Compound No. 32 | Printing portion | 1.14 | 1.00 | 1.00 | 1.13 |
| | | Ground portion | 0.05 | 0.07 | 0.06 | 0.08 |
| 4-11 | Compound No. 34 | Printing portion | 1.27 | 1.19 | 1.11 | 1.14 |
| | | Ground portion | 0.05 | 0.06 | 0.06 | 0.08 |
| 4-12 | Compound No. 36 | Printing portion | 1.26 | 1.20 | 1.16 | 1.18 |
| | | Ground portion | 0.05 | 0.06 | 0.07 | 0.07 |
| 4-13 | Compound No. 37 | Printing portion | 1.31 | 1.25 | 1.19 | 1.24 |
| | | Ground portion | 0.05 | 0.06 | 0.06 | 0.07 |

Comparative Compound 5

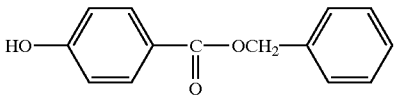

Comparative Compound 6

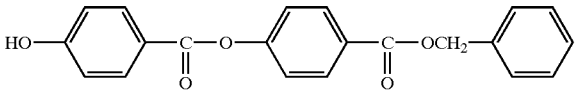

Example 5

Twenty g of 3-(N-ethyl-N-isoamylamino)-6-methyl-7-anilinofluoran and 100 g of 10% polyvinyl alcohol aqueous solution were sufficiently ground in a ball mill, so that a dispersing solution A was obtained. Then, 20 g of acetoacetic acid o-chloroanilide and 100 g of 10% polyvinyl alcohol aqueous solution were sufficiently ground in a ball mill, so that a dispersing solution B was obtained. In addition, each 20 g of the same sample compound described in Example 4 and Comparative example 4 (Table 9) and 100 g of 10% polyvinyl alcohol aqueous solution were sufficiently ground in a ball mill respectively, so that a dispersing solution C was obtained. The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained. Using the obtained the thermal recording body, the test was performed in the same manner as in Example 2. The results were shown in the following Table 9.

TABLE 9

| NO. | Sample compound | Concentration | Initial concentration | Preservative stability (Concentration) Heat resistance | Light resistance | Oil resistance |
|---|---|---|---|---|---|---|
| Comparative example | | | | | | |
| 5-1 | Comparative compound 5 | Printing portion | 1.28 | 0.98 | 0.90 | 0.60 |
| | | Ground portion | 0.07 | 0.12 | 0.15 | 0.08 |
| 5-2 | Comparative compound 6 | Printing portion | 1.27 | 1.02 | 0.93 | 0.62 |
| | | Ground portion | 0.07 | 0.11 | 0.14 | 0.08 |

TABLE 9-continued

| NO. | Sample compound | Concentration | Initial concentration | Preservative stability (Concentration) Heat resistance | Light resistance | Oil resistance |
|---|---|---|---|---|---|---|
| Example | | | | | | |
| 5-1 | Compound No. 17 | Printing portion | 1.18 | 1.04 | 1.07 | 1.10 |
| | | Ground portion | 0.06 | 0.07 | 0.07 | 0.08 |
| 5-2 | Compound No. 19 | Printing portion | 1.28 | 1.22 | 1.10 | 1.23 |
| | | Ground portion | 0.05 | 0.07 | 0.06 | 0.07 |
| 5-3 | Compound No. 21 | Printing portion | 1.29 | 1.25 | 1.14 | 1.24 |
| | | Ground portion | 0.05 | 0.07 | 0.06 | 0.08 |
| 5-4 | Compound No. 22 | Printing portion | 1.29 | 1.23 | 1.14 | 1.23 |
| | | Ground portion | 0.05 | 0.06 | 0.06 | 0.07 |
| 5-5 | Compound No. 23 | Printing portion | 1.33 | 1.20 | 1.19 | 1.25 |
| | | Ground portion | 0.05 | 0.06 | 0.07 | 0.07 |
| 5-6 | Compound No. 25 | Printing portion | 1.24 | 1.21 | 1.12 | 1.20 |
| | | Ground portion | 0.05 | 0.06 | 0.06 | 0.07 |
| 5-7 | Compound No. 27 | Printing portion | 1.10 | 1.02 | 1.01 | 0.97 |
| | | Ground portion | 0.06 | 0.07 | 0.08 | 0.07 |
| 5-8 | Compound No. 29 | Printing portion | 1.29 | 1.24 | 1.09 | 1.20 |
| | | Ground portion | 0.05 | 0.06 | 0.06 | 0.07 |
| 5-9 | Compound No. 30 | Printing portion | 1.31 | 1.22 | 1.17 | 1.19 |
| | | Ground portion | 0.05 | 0.06 | 0.06 | 0.07 |
| 5-10 | Compound No. 32 | Printing portion | 1.16 | 1.02 | 1.10 | 1.00 |
| | | Ground portion | 0.05 | 0.06 | 0.08 | 0.07 |
| 5-11 | Compound No. 34 | Printing portion | 1.27 | 1.21 | 1.12 | 1.13 |
| | | Ground portion | 0.06 | 0.06 | 0.06 | 0.08 |
| 5-12 | Compound No. 36 | Printing portion | 1.29 | 1.22 | 1.11 | 1.16 |
| | | Ground portion | 0.05 | 0.05 | 0.06 | 0.07 |
| 5-13 | Compound No. 37 | Printing portion | 1.32 | 1.25 | 1.13 | 1.19 |
| | | Ground portion | 0.06 | 0.07 | 0.07 | 0.08 |

Example 6

Twenty g of 3-(N,N-dibutylamino)-6-methyl-7-anilinofluoran and 100 g of 10 percent by weight polyvinyl alcohol aqueous solution were sufficiently ground in a ball mill, so that a dispersing solution A was obtained. Then, 20 g of bis(4-methylbenzyl)oxalate and 100 g of 10 percent by weight polyvinyl alcohol aqueous solution were sufficiently ground in a ball mill, so that a dispersing solution B was obtained.

Next, a variety of (poly) 4-hydroxybenzoic acid ester derivatives in accordance with the present invention (Table 10) were used as sample compounds, and each 20 g of the sample compounds and 100 g of 10 percent by weight polyvinyl alcohol aqueous solution were sufficiently ground in a ball mill respectively, so that a variety of dispersing solutions C were obtained. The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained.

At the same time, using Comparative confounds 7 and 8 shown below Table 10 instead of the above described condensation products, thermal recording materials as Comparative examples were obtained.

A chromogenic concentration of a recording image printed at a pulse width of 0.8 msec using the obtained thermal recording material and a thermal printing apparatus (TH-PMD: manufactured by Ookuradennki Co.), and a concentration of a ground portion (an initial concentration) were measured with a Macbeth densitometer (manufactured by Macbeth Co. RD-933 type). With respect to a thermal recording body which was obtained by developing colors of the thermal recording material, a preservative stability against heat test (storage at a temperature of 60° C. under dry condition for 24 hours), a preservative stability against light test (radiation for six hours in a carbon arc fadeometer), and a preservative stability against oil test (after stamping dioctylphthalate on the printing portion and the ground portion of the thermal recording body, it was stored at a temperature of 40° C. under dry condition for 24 hours.) were performed. Then, changes in the concentration of the printing portion and the ground portion were measured. The concentration of the ground portion was also measured using a yellow filter at the preservative stability against light test. These results were shown in the following Table 10.

TABLE 10

| NO. | Sample compound | Measuring | Initial concentration | Preservative stability (Concentration) Heat resistance | Light resistance | Oil resistance |
|---|---|---|---|---|---|---|
| Comparative example | | | | | | |
| 6-1 | Comparative compound 7 | Printing portion | 1.27 | 0.98 | 0.91 | 0.60 |
| | | Ground portion | 0.07 | 0.12 | 0.16 | 0.09 |
| 6-2 | Comparative compound 8 | Printing portion | 1.24 | 1.00 | 0.92 | 0.61 |
| | | Ground portion | 0.07 | 0.11 | 0.15 | 0.09 |
| Example | | | | | | |
| 6-1 | Compound No. 38 | Printing portion | 1.30 | 1.24 | 1.10 | 1.11 |
| | | Ground portion | 0.04 | 0.05 | 0.05 | 0.05 |
| 6-2 | Compound No. 41 | Printing portion | 1.27 | 1.11 | 1.09 | 1.05 |
| | | Ground portion | 0.05 | 0.07 | 0.09 | 0.06 |
| 6-3 | Compound No. 42 | Printing portion | 1.28 | 1.02 | 1.15 | 1.01 |
| | | Ground portion | 0.05 | 0.06 | 0.06 | 0.07 |
| 6-4 | Compound No. 45 | Printing portion | 1.10 | 1.01 | 0.97 | 0.88 |
| | | Ground portion | 0.05 | 0.06 | 0.06 | 0.06 |
| 6-5 | Compound No. 46 | Printing portion | 1.10 | 1.00 | 0.97 | 0.95 |
| | | Ground portion | 0.05 | 0.07 | 0.06 | 0.06 |
| 6-6 | Compound No. 49 | Printing portion | 1.11 | 0.93 | 1.00 | 0.89 |
| | | Ground portion | 0.06 | 0.07 | 0.07 | 0.08 |

Comparative Compound 7

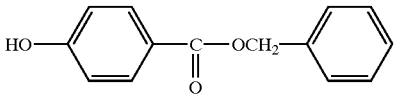

Comparative Compound 8

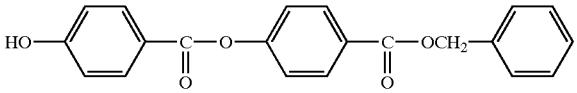

Example 7

Twenty g of 3-(N-ethyl-N-isoamylamino)-6-methyl-7-anilinofluoran and 100 g of 10% polyvinyl alcohol aqueous solution were sufficiently ground in a ball mill, so that a dispersing solution A was obtained. Then, 20 g of acetoacetic acid o-chloroanilide and 100 g of 10% polyvinyl alcohol aqueous solution were sufficiently ground in a ball mill, so that a dispersing solution B was obtained.

Next, a variety of (poly) 4-hydroxybenzoic acid ester derivatives in accordance with the present invention (Table 11) were used as sample compounds, and each 20 g of the sample compounds and 100 g of 10 percent by weight polyvinyl alcohol aqueous solution were sufficiently ground in a ball mill respectively, so that a variety of dispersing solutions C were obtained. The above described dispersing solutions A, B, and C were mixed at a ratio by weight of 1:2:2. Then, 50 g of calcium carbonate was added to 200 g of the mixed solution and was sufficiently dispersed so as to prepare an applying liquid. This applying liquid was applied on a base paper with 50 g/m$^2$ at a thickness of 32 $\mu$m and dried, so that a thermal recording material was obtained.

At the same time, using the above described Comparative confounds 7 and 8 instead of the condensation products in accordance with the present invention, thermal recording materials as Comparative examples were obtained. Using the obtained the thermal recording body, the test was performed in the same manner as in Example 6. The results were shown in Table 11.

TABLE 11

| NO. | Sample compound | Measuring | Initial concentration | Preservative stability (Concentration) Heat resistance | Light resistance | Oil resistance |
|---|---|---|---|---|---|---|
| Comparative example | | | | | | |
| 7-1 | Comparative compound 7 | Printing portion | 1.28 | 0.98 | 0.90 | 0.60 |
| | | Ground portion | 0.07 | 0.12 | 0.15 | 0.09 |
| 7-2 | Comparative compound 8 | Printing portion | 1.27 | 1.02 | 0.93 | 0.62 |
| | | Ground portion | 0.07 | 0.11 | 0.14 | 0.10 |
| Example | | | | | | |
| 7-1 | Compound No. 38 | Printing portion | 1.18 | 1.04 | 0.97 | 0.91 |
| | | Ground portion | 0.04 | 0.06 | 0.05 | 0.06 |

TABLE 11-continued

| NO. | Sample compound | Measuring | Initial concentration | Preservative stability (Concentration) Heat resistance | Light resistance | Oil resistance |
|---|---|---|---|---|---|---|
| 7-2 | Compound No. 41 | Printing portion | 1.28 | 1.02 | 1.00 | 0.99 |
| | | Ground portion | 0.05 | 0.07 | 0.06 | 0.07 |
| 7-3 | Compound No. 42 | Printing portion | 1.29 | 1.25 | 1.14 | 1.14 |
| | | Ground portion | 0.04 | 0.06 | 0.06 | 0.07 |
| 7-4 | Compound No. 45 | Printing portion | 1.29 | 1.03 | 0.92 | 0.85 |
| | | Ground portion | 0.05 | 0.06 | 0.06 | 0.07 |
| 7-5 | Compound No. 46 | Printing porti6n | 1.09 | 0.97 | 0.94 | 0.99 |
| | | Ground portion | 0.05 | 0.06 | 0.07 | 0.08 |
| 7-6 | Compound No. 49 | Printing portion | 1.10 | 1.00 | 0.96 | 0.85 |
| | | Ground portion | 0.05 | 0.06 | 0.08 | 0.06 |

It is clear from the above described Comparative examples and Examples that, when (poly) 4-hydroxybenzoic acid ester derivatives in accordance with the present invention are utilized, initial chromogenic sensitivity is excellent and preservative stability is superior, and that disappearance of a printing portion and ground portion fog seldom happen, even after a long period of time for storage.

In contrast thereto, when the conventional poly 4-hydroxybenzoic acid ester derivatives are utilized, concentration of a printing portion on the thermal recording material significantly decreases and the preservative stability of the recording material body is insufficient.

INDUSTRIAL USE POSSIBIRITY

By containing a (poly) 4-hydroxybenzoic acid ester derivative in a thermal recording layer, disappearance of the color-developed portion and ground portion do seldom occur after the recording material body is stored under a several condition. That is, a thermal recording material which is superior in a preservative stability can be obtained.

What is claimed is:

1. A thermal recording material comprising a support and a thermal recording layer formed on the support and comprising a chromogenic substance and a developer which develops chromogenic substance with heat to a surface of the support, wherein the thermal recording layer contains a condensation reaction product of a carboxylic acid component (A) with a polyhydric alcohol component (B) as an essential component, wherein the carboxylic acid component (A) comprises (poly) 4-hydroxybenzoic acid represented by the following general formula (I) as an essential component and another monocarboxylic acid and/or dicarboxylic acid as an arbitrary component, and wherein the polyhydric alcohol component (B) comprises a trihydric or more alcohol represented by the following general formula (II) as an essential component and a dihydric low molecular-weight alcohol as an arbitrary component:

(I)

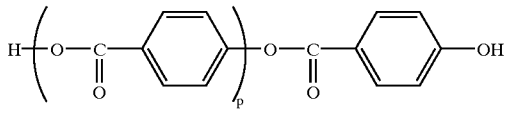

wherein in the general formula (I), the letter p denotes an integer ranging from 0 to 2, and (II)

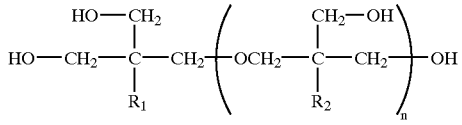

wherein in the general formula (II), the letter n denotes an integer ranging from 0 to 9; and $R_1$ and $R_2$ that may be present in n types are, independently of one another, a hydroxymethyl or an alkyl group having from 1 to 8 carbon atoms.

2. A thermal recording material according to claim 1, wherein the condensation reaction product as the essential component is obtained by using 4-hydroxybenzoic acid at a mole fraction ranging from 1 to 150, another monocarboxylic acid at a mole fraction ranging from 0 to 50, the dicarboxylic acid at a mole fraction ranging from 0 to 1, the trihydric or more alcohol at a mole fraction ranging from 1 to 50, and the the dihydric low molecular-weight alcohol at a mole fraction ranging from 0 to 50.

3. A thermal recording material according to claim 1, wherein the letter n denotes ranging from 1 to 9, and $R_1$ and $R_2$ are hydroxymethyl.

4. A thermal recording material according to claim 1, wherein the letter n denotes ranging from 1 to 9, and $R_1$ and $R_2$ are ethyl.

* * * * *